US011802733B2

(12) United States Patent
Wei et al.

(10) Patent No.: US 11,802,733 B2
(45) Date of Patent: Oct. 31, 2023

(54) HEAT EXCHANGER

(71) Applicant: ZHEJIANG DUNAN ARTIFICIAL ENVIRONMENT CO., LTD., Zhejiang (CN)

(72) Inventors: Wenjian Wei, Zhejiang (CN); Wenyong Ma, Zhejiang (CN); Guanjun Wang, Zhejiang (CN); Qing Xiao, Zhejiang (CN); Yi Fan, Zhejiang (CN); Xinyu Liang, Zhejiang (CN)

(73) Assignee: ZHEJIANG DUNAN ARTIFICIAL ENVIRONMENT CO., LTD., Zhejiang (CN)

( * ) Notice: Subject to any disclaimer, the term of this patent is extended or adjusted under 35 U.S.C. 154(b) by 5 days.

(21) Appl. No.: 17/763,675

(22) PCT Filed: Sep. 27, 2020

(86) PCT No.: PCT/CN2020/118180

§ 371 (c)(1),
(2) Date: Mar. 25, 2022

(87) PCT Pub. No.: WO2021/057984

PCT Pub. Date: Apr. 1, 2021

(65) Prior Publication Data

US 2022/0333865 A1 Oct. 20, 2022

(30) Foreign Application Priority Data

Sep. 27, 2019 (CN) ..... 201921630087.5
Sep. 27, 2019 (CN) ..... 201921630139.9
Nov. 22, 2019 (CN) ..... 201922038524.0

(51) Int. Cl.
*F28D 1/03* (2006.01)
*F28D 9/04* (2006.01)
*F28F 11/00* (2006.01)

(52) U.S. Cl.
CPC ..... *F28D 1/03* (2013.01); *F28D 9/04* (2013.01); *F28F 11/00* (2013.01)

(58) Field of Classification Search
CPC ..... F28D 1/03; F28D 9/04; F28F 11/00
See application file for complete search history.

(56) References Cited

U.S. PATENT DOCUMENTS 4,860,823 A 8/1989 Noguchi
2004/0050531 A1* 3/2004 Horiuchi ..... F28D 1/0375 165/41
2020/0064076 A1* 2/2020 Deshpande ..... F28D 9/0068

FOREIGN PATENT DOCUMENTS

CH 527403 A 8/1972
CN 1515864 A 7/2004
(Continued)

*Primary Examiner* — Devon Russell
(74) *Attorney, Agent, or Firm* — Gang Yu

(57) ABSTRACT

Some embodiments of the present disclosure provides a heat exchanger, including: a plurality of flat pipes disposed at intervals, wherein the flat pipe is provided with an inlet portion and an outlet portion, and both the inlet portion and the outlet portion are located on a first end of the flat pipe; a first sealing cushion block, disposed between two adjacent flat pipes; and a flow collecting portion, provided with a first opening portion and a second opening portion, wherein the first opening portion is disposed opposite to the inlet portion, and the second opening portion is disposed opposite to the outlet portion. The first sealing cushion block includes a first sealing portion and a second sealing portion.

19 Claims, 11 Drawing Sheets

(56) References Cited

FOREIGN PATENT DOCUMENTS

| | | | | | |
|---|---|---|---|---|---|
| CN | 104236332 | A | | 12/2014 | |
| CN | 107614999 | A | | 1/2018 | |
| CN | 210922273 | U | | 7/2020 | |
| CN | 210922274 | U | | 7/2020 | |
| DE | 3047411 | A1 | | 7/1982 | |
| DE | 3440489 | A1 | | 5/1986 | |
| DE | 102009056509 | A1 | * | 6/2011 | ..... F28D 1/05366 |
| WO | 8607628 | A1 | | 12/1986 | |
| WO | WO-2009062310 | A1 | * | 5/2009 | ..... F28D 1/0325 |
| WO | WO-2011012684 | A2 | * | 2/2011 | ..... F28F 9/0221 |
| WO | 2015197185 | A1 | | 12/2015 | |

* cited by examiner

A–A

HEAT EXCHANGER

CROSS-REFERENCE TO RELATED APPLICATION

The present disclosure claims the priority of Chinese Application No. 201921630139.9, filed in the Chinese Patent Office on Sep. 27, 2019, and entitled "Heater Exchanger". The present disclosure claims the priority of Chinese Application No. 201921630087.5, filed in the Chinese Patent Office on Sep. 27, 2019, and entitled "Heater Exchanger". The present disclosure claims the priority of Chinese Application No. 201922038524.0, filed in the Chinese Patent Office on Nov. 22, 2019, and entitled "Heater Exchange Device".

TECHNICAL FIELD

The present disclosure relates to a technical field of heat exchangers, and in particular, to a heat exchanger.

BACKGROUND

In an art known to inventors, a heat exchanger generally includes a circular flow collecting pipe and a plurality of flat pipes. The circular flow collecting pipe is provided with a plurality of plug-in holes, and the plurality of flat pipes are disposed with the plurality of plug-in holes in a one-to-one correspondence manner. Each flat pipe is plugged into the corresponding plug-in hole, and then is welded.

During a welding process, the flat pipe is subjected to the rigid constraint of the plug-in hole of the flow collecting pipe, thereof even if the flat pipe is subjected to a pre-tightening force of a fixture, the flat pipe will hardly move in a height direction, especially the flat pipe that is close to an end portion location of the flow collecting pipe. During the welding, since a composite layer on a plate surface of the flat pipe will melt, some welding points near the plug-in holes of the flow collecting pipe will be difficult to be welded, which will easily form false welding, thus affecting the pressure resistance of a product.

At the same time, in the art known to inventors, an inlet and an outlet are respectively located on both ends of the flat pipe, so it is necessary to weld the both ends of the flat pipe, which increases the workload. Meanwhile, the structure is not compact enough, and the space utilization rate is relatively low.

SUMMARY

Some embodiments of the present disclosure provide a heat exchanger, so as to solve a technical problem of an insufficient compact structure of the heat exchanger in the art known to inventors.

Some embodiments of the present disclosure provide a heat exchanger, which includes: a plurality of flat pipes, the plurality of flat pipes are disposed at intervals, each of the plurality of flat pipes is provided with an inlet portion and an outlet portion, both the inlet portion and the outlet portion are located on a first end of a corresponding flat pipe, and the both the inlet portion and the outlet portion are disposed at intervals; a first sealing cushion block, disposed between two adjacent flat pipes of the plurality of flat pipes, wherein the first sealing cushion block is located on a first end of the two adjacent flat pipes of the plurality of flat pipes, so as to seal a gap between the two adjacent flat pipes of the plurality of flat pipes by the first sealing cushion block; and a flow collecting portion, provided with a first opening portion and a second opening portion, wherein the first opening portion is disposed opposite to the inlet portion of the each of the plurality of flat pipes, and the second opening portion is disposed opposite to the outlet portion of the each of the plurality of flat pipes, wherein the first sealing cushion block includes a first sealing portion and a second sealing portion, the first sealing portion is disposed between inlet portions of the two adjacent flat pipes of the plurality of flat pipes, the second sealing portion is disposed between outlet portions of the two adjacent flat pipes of the plurality of flat pipes, the inlet portion and at least part of the first sealing portion are both plugged into the first opening portion, so as to form a first flow collecting channel in a surrounding encircling manner, and the outlet portion of the each of the plurality of flat pipes and at least part of the second sealing portion are both plugged into the second opening portion, so as to form a second flow collecting channel in a surrounding manner.

In some embodiments, the flow collecting portion includes a first flow collecting shell, the first flow collecting shell includes a first main shell and a first plug-in shell, the first plug-in shell is disposed on the first main shell, the first plug-in shell is located on an end portion of the first main shell, the first plug-in shell is provided with the first opening portion, and the inlet portion and of the each of the plurality of flat pipes at least part of the first sealing portion are both plugged at the first plug-in shell.

In some embodiments, the flow collecting portion includes a second flow collecting shell, the second flow collecting shell includes a second main shell and a second plug-in shell, the second plug-in shell is disposed on the second main shell, the second plug-in shell is located on an end portion of the second main shell, the second plug-in shell is provided with the second opening portion, and the outlet portion of the each of the plurality of flat pipes and at least part of the second sealing portion are both plugged at the second plug-in shell.

In some embodiments, the first plug-in shell includes a first plug board and a second plug board, the first plug board and the second plug board are oppositely disposed on both ends of the first main shell, and the first plug board and the second plug board are disposed at intervals so as to form the first opening portion, so that the inlet portion of the each of the plurality of flat pipes and at least part of the first sealing portion are both plugged between the first plug board and the second plug board.

In some embodiments, along an extension direction from the first main shell to the first plug-in shell, the distance between the first plug board and the second plug board gradually decreases.

In some embodiments, the first sealing portion includes a first main body block and a first plug-in block, the first plug-in block is disposed on the first main body block, the first main body block is disposed on the first end of the two adjacent flat pipes of the plurality of flat pipes, and the first plug-in block is plugged into the first opening portion.

In some embodiments, the first plug-in block has a first side surface, a second side surface and a first arc-shaped concave surface, the first side surface, the first arc-shaped concave surface and the second side surface are connected in sequence, the first arc-shaped concave surface is located on one side of the first plug-in block away from the first main body block, the first side surface is plugged at the first plug board, and the second side surface is plugged at the second plug board.

In some embodiments, the heat exchanger further includes a plurality of first positioning structures and a plurality of second positioning structures matching the plurality of first positioning structures, the heat exchanger includes a plurality of the first sealing cushion blocks, a first end of each of the plurality of flat pipes is provided with one second positioning structure of the plurality of second positioning structures, and the plurality of first positioning structures are disposed opposite to the plurality of second positioning structures in a one-to-one correspondence manner, so as to position the plurality of first sealing cushion blocks by means of a cooperation of the plurality of first positioning structures and the plurality of second positioning structures.

In some embodiments, each of the plurality of first positioning structures is a first positioning protrusion, each of the plurality of second positioning structures is a first positioning groove, the first positioning protrusion is disposed opposite to the first positioning groove, and the first positioning protrusion is disposed in the first positioning groove, so as to position the first sealing cushion block.

In some embodiments, he heat exchanger includes a plurality of the first sealing cushion blocks, each of the plurality of first sealing cushion blocks has a first fitting surface and a second fitting surface, which are disposed opposite to each other, the first end of the each of the plurality of flat pipes has a first surface and a second surface, which are disposed opposite to each other, the first fitting surface and the first surface of one flat pipe of the two adjacent flat pipes are disposed in a matching manner, and the second fitting surface and the second surface of another flat pipe of the two adjacent flat pipes are disposed in the matching manner, so that the first fitting surface is disposed to fit a corresponding first surface, and the second fitting surface is disposed to fit a corresponding second surface.

In some embodiments, the flow collecting portion is further provided with a third opening portion and a fourth opening portion, which are disposed opposite to each other, and are disposed to form a preset angle with a flow direction of fluid in the each of the plurality of flat pipes along an extension direction from the third opening portion to the fourth opening portion; and the heat exchanger further includes a plurality of sealing covers, and both the third opening portion and the fourth opening portion are respectively provided with at least one sealing cover of the plurality of sealing covers, so as to seal the third opening portion and the fourth opening portion by the plurality of sealing covers.

In some embodiments, the heat exchanger further includes a plurality of second sealing cushion blocks, the plurality of sealing covers are respectively provided at both ends of the plurality of flat pipes, at least one second sealing cushion block of the plurality of second sealing cushion blocks is disposed between a flat pipe located at an end of the plurality of flat pipes and a corresponding sealing cover, and one end of each of the plurality of second sealing cushion blocks close to the corresponding sealing cover is provided with a third positioning structure, so as to position the corresponding sealing cover by the third positioning structure.

In some embodiments, each of the plurality of second sealing cushion blocks includes a third sealing portion and a fourth sealing portion, the third sealing portion and the fourth sealing portion are connected with each other, the third sealing portion is disposed at the inlet portion of the flat pipe located at an end of the plurality of flat pipes, and the fourth sealing portion is disposed at the outlet portion of the flat pipe located at an end of the plurality of flat pipes; the third positioning structure includes a first positioning step, the third sealing portion includes a third main body block and a third plug-in block, the third plug-in block is disposed on the third main body block, and the third main body block protrudes from the third plug-in block to form the first positioning step in a surrounding manner, so as to position the sealing cover by the first positioning step; and the third positioning structure includes a second positioning step, the fourth sealing portion includes a fourth main body block and a fourth plug-in block, the fourth plug-in block is disposed on the fourth main body block, and the fourth main body block protrudes from the fourth plug-in block to form the second positioning step in a surrounding manner, so as to position the sealing cover by the second positioning step.

In some embodiments, a fourth positioning structure is further disposed on the flat pipe located at an end of the plurality of flat pipes, a fifth positioning structure matching the fourth positioning structure is further disposed on the second sealing cushion block, and the fourth positioning structure is disposed opposite to the fifth positioning structure, so as to position the second sealing cushion block by the fourth positioning structure and the fifth positioning structure.

In some embodiments, the fourth positioning structure is a second positioning protrusion, the fifth positioning structure is a second positioning groove, the second positioning protrusion is disposed opposite to the second positioning groove, and the second positioning protrusion is disposed in the second positioning groove, so as to position the second sealing portion.

In some embodiments, the each of the plurality of flat pipes is provided with a fluid channel, and the fluid channel is a U-shaped structure.

In some embodiments, the first sealing portion includes a first main body block and a first plug-in block, the first plug-in block is disposed on the first main body block, the first plug-in block and the inlet portion of the each of the plurality of flat pipes are both plugged into the first opening portion, so as to form the first flow collecting channel in a surrounding manner, and along an extension direction from the first main body block to the first plug-in block, a plug-in width of the first plug-in block gradually increases; and the second sealing portion includes a second main body block and a second plug-in block, the second plug-in block is disposed on the second main body block, the second plug-in block and the outlet portion of the each of the plurality of flat pipes are both plugged into the second opening portion, so as to form the second flow collecting channel in a surrounding manner, and along an extension direction from the second main body block to the second plug-in block, a plug-in width of the second plug-in block gradually increases.

In some embodiments, along an extension direction from the first main shell to the first plug-in shell, a plug-in gap of the first plug-in shell gradually decreases; and along an extension direction from the second main shell to the second plug-in shell, the plug-in gap of the second plug-in shell gradually decreases.

In some embodiments, the first plug-in block is trumpet-shaped; and the second plug-in block is trumpet-shaped.

In some embodiments, the heat exchanger further includes: a clamping structure, the clamping structure is disposed on the first sealing cushion block, and at least part of the flow collecting portion is clamped into the clamping structure.

In some embodiments, the clamping structure includes a plurality of clamping grooves, and the plurality of clamping grooves are disposed on the first sealing cushion block at intervals.

In some embodiments, the first plug-in block has a first side surface, an arc-shaped surface and a second side surface, the first side surface, the arc-shaped surface and the second side surface are connected in sequence, the first side surface and the second side surface are both used for fitting with the first flow collecting shell, and the arc-shaped surface is used for forming a flow collecting channel with the first flow collecting shell in a surrounding manner.

In some embodiments, each of the inlet portions of the plurality of flat pipes is a first arc-shaped port, and the first arc-shaped port is plugged into the first opening portion, so that the first flow collecting channel communicates with the fluid channel in the each of the plurality of flat pipes; and each of the inlet portions of the plurality of flat pipes is a second arc-shaped port, and the second arc-shaped port is plugged into the second opening portion, so that the second flow collecting channel communicates with the fluid channel in the each of the plurality of flat pipes.

In some embodiments, each of the plurality of flat pipes includes a first forming plate and a second forming plate, a surface of the each of the plurality of flat pipes is provided with a groove extending along a length direction of the each of the plurality of flat pipes, and the groove is formed by the first forming plate and the second forming plate by means of depressing toward inner sides of the each of the plurality of flat pipes; and the heat exchanger further includes a heat exchange fin, the heat exchange fin is installed between the two adjacent flat pipes of the plurality of flat pipes, the heat exchange fin is provided with a plurality of notches at a location corresponding to the groove, the heat exchange fin includes a plurality of flow deflectors, the plurality of notches and the plurality of flow deflector are disposed in an one-to-to corresponding manner, and the plurality of notches, the plurality of flow deflectors and the groove form a flow guide channel together.

In some embodiments, the heat exchange fin is a corrugated sheet, and the plurality of notches are disposed at wave crests and wave troughs of the heat exchange fin respectively.

In some embodiments, each of the plurality of flow deflectors is a part of the heat exchange fin, each of the plurality of flow deflectors is formed by the heat exchange fin by depressing along a corresponding notch, and each of the plurality of flow deflectors does not penetrate through the heat exchange fin, and each of the plurality of flow deflectors is located on one side of the heat exchange fin.

In some embodiments, each of plurality of flow deflectors is a part of the heat exchange fin, each of the plurality of flow deflectors is formed by folding the heat exchange fin along one side of a corresponding notch.

In some embodiments, the plurality of flow deflectors are all folded in a same direction.

In some embodiments, each of the plurality of the flow deflectors is parallel to a length direction of each of the plurality flat pipes.

In some embodiments, a length of the flow deflector is less than a wave pitch of the heat exchange fin.

In some embodiments, the heat exchanger includes a shutter which is formed on the heat exchange fin, and a depth of the notch is less than a distance from a top of the fin to the shutter.

According to the technical solutions of some embodiments in the present disclosure, by disposing the inlet portion and the outlet portion of the flat pipe on the same end of the flat pipe, only the first sealing cushion block needs to be disposed on one end of the flat pipe. By plugging both at least part of the first sealing portion and the inlet end of the flat pipe into the first opening portion, the flow collecting channel on the inlet side can be formed in the encircling manner, and by plugging both at least part of the second sealing portion and the inlet end of the flat pipe into the second opening portion, the flow collecting channel on the outlet side can be formed in the encircling manner, therefore the flow collecting channel on the inlet side and the flow collecting channel on the outlet side are located on the same end of the flat pipe, which is convenient to improve the compactness of the overall structure. Therefore, by means of the technical solutions provided in the present disclosure, the technical problem of an insufficient compact structure of the heat exchanger in the art known to inventors can be solved.

BRIEF DESCRIPTION OF THE DRAWINGS

The drawings constituting a part of the present disclosure are used for providing a further understanding of the present disclosure, and exemplary embodiments of the present disclosure and descriptions thereof are used for explaining the present disclosure, but do not constitute improper limitations of the present disclosure. In the drawings.

Figure 1:
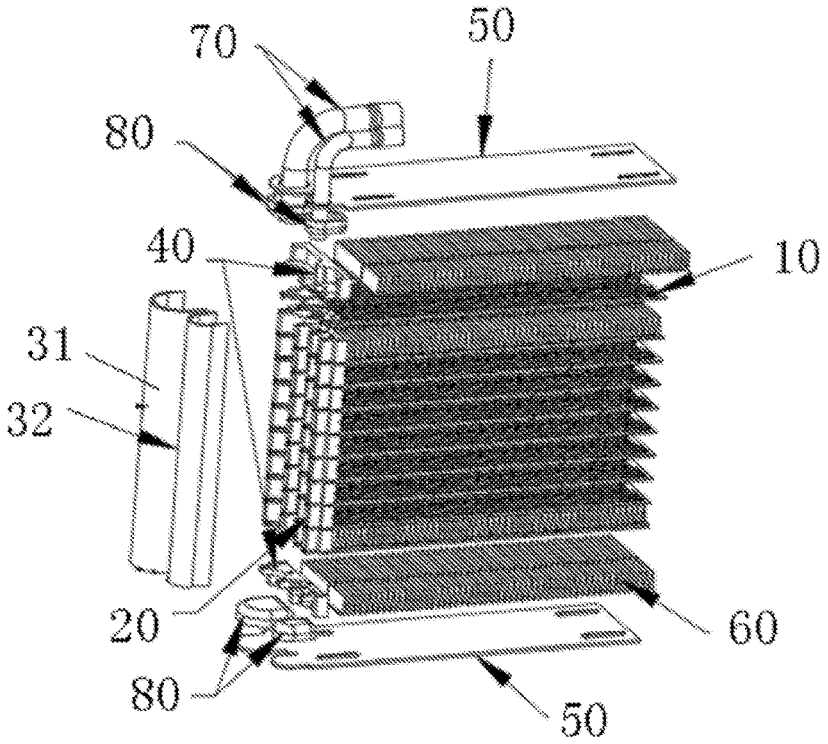
FIG. 1 illustrates an exploded view of a heat exchanger provided according to some embodiments of the present disclosure.
Figure 2:
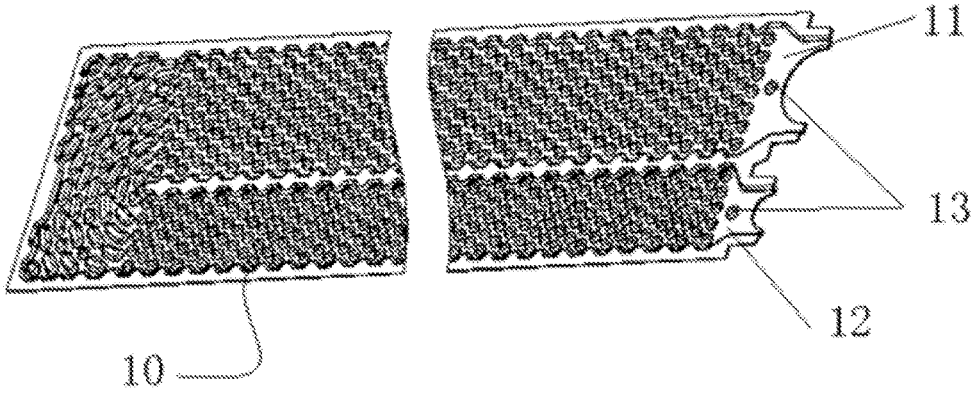
FIG. 2 illustrates a schematic structural diagram of a flat pipe of a heat exchanger provided according to some embodiments of the present disclosure.
Figure 3:
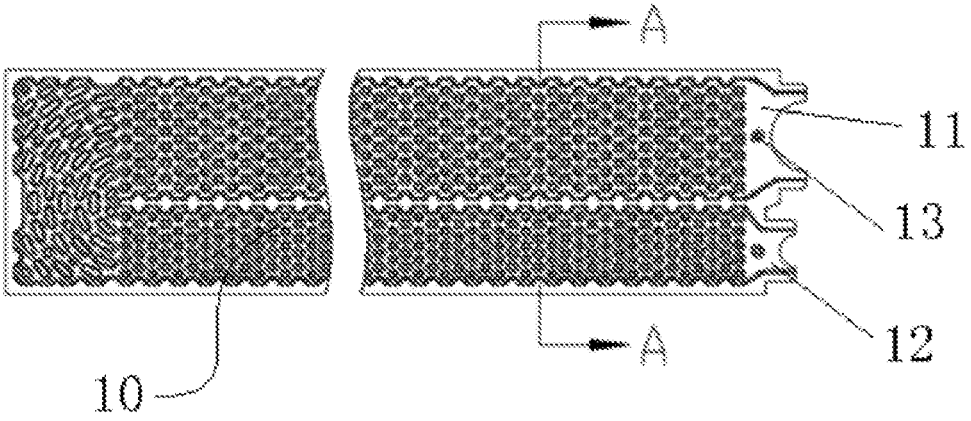
FIG. 3 illustrates a front view of a flat pipe of a heat exchanger provided according to some embodiments of the present disclosure.
Figure 4:
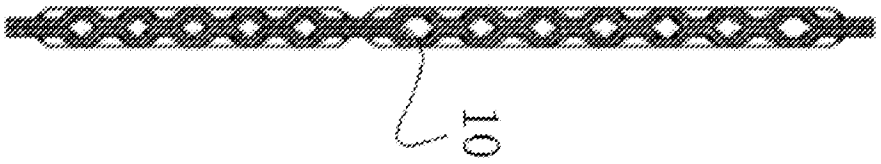
FIG. 4 illustrates the A-A direction view in FIG. 3.
Figure 5:
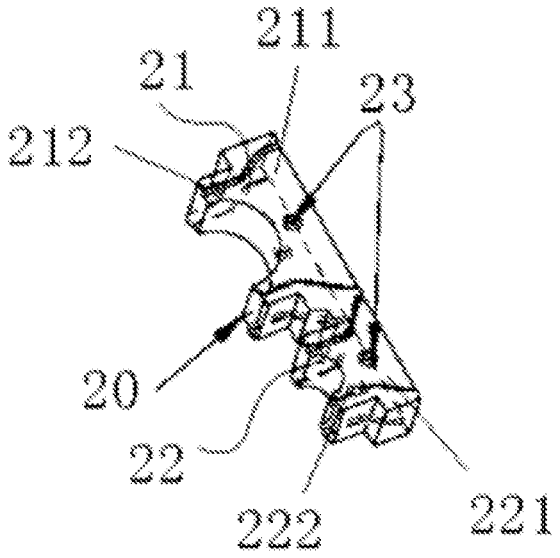
FIG. 5 illustrates a schematic structural diagram of a first sealing cushion block provided according to some embodiments of the present disclosure.
Figure 6:
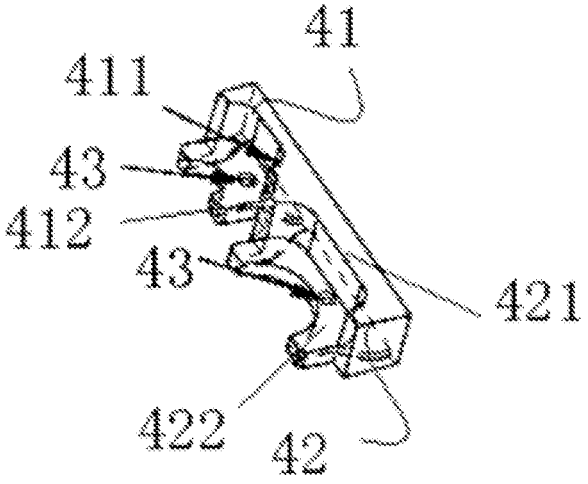
FIG. 6 illustrates a schematic structural diagram of a second sealing cushion block provided according to some embodiments of the present disclosure.
Figure 7:
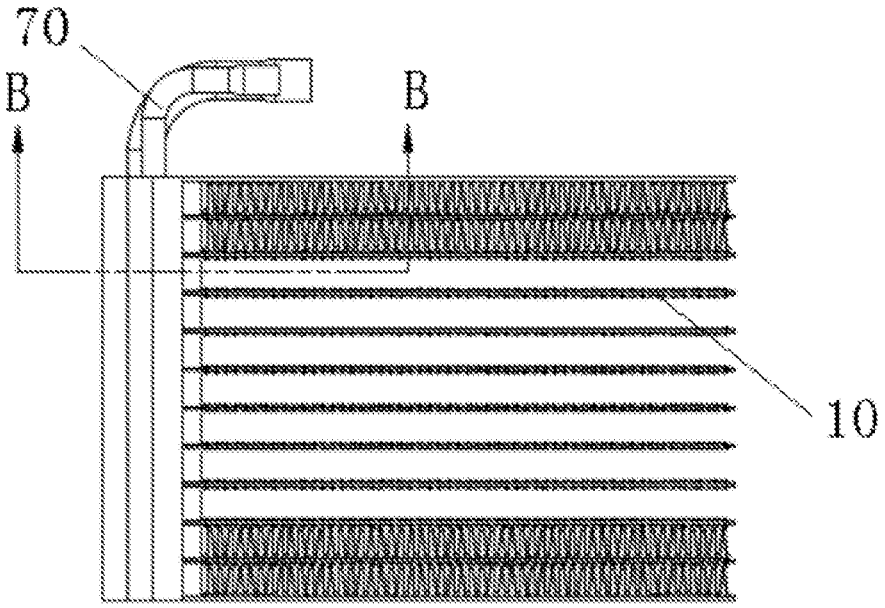
FIG. 7 illustrates a front view of a heat exchanger provided according to some embodiments of the present disclosure.
Figure 8:
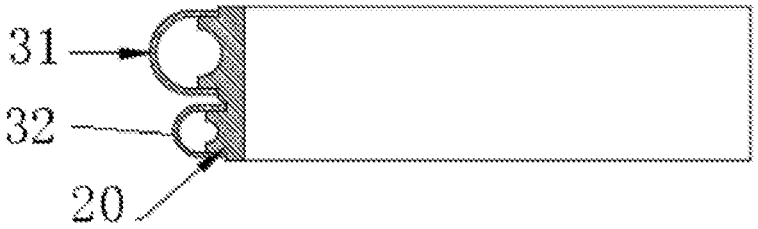
FIG. 8 illustrates the B-B direction view in FIG. 7.
Figure 9:
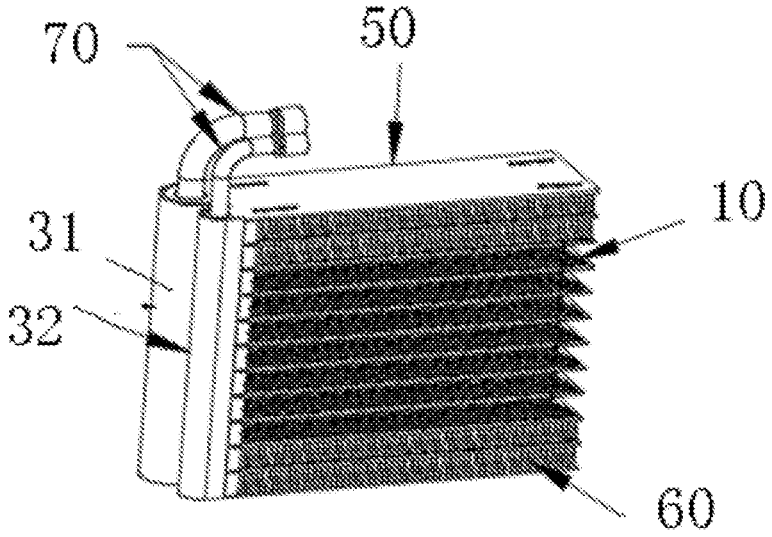
FIG. 9 illustrates a schematic structural diagram of a heat exchanger provided according to some embodiments of the present disclosure.

The above drawings include the following reference signs:

10. flat pipe; 11. inlet portion; 12. outlet portion; 13. second positioning structure; 14. groove; 20. first sealing cushion block; 21. first sealing portion; 211. first main body block; 212. first plug-in block; 22. second sealing portion; 221. second main body block; 222. second plug-in block; 23. first positioning structure; 24. clamping groove; 31. first flow collecting shell; 32. second flow collecting shell; 40. second sealing cushion block; 41. third sealing portion; 411. third main body block; 412. third plug-in block; 42. fourth sealing portion; 421. fourth main body block; 42. fourth plug-in block; 43. fifth positioning structure; 50. side plate; 60. heat exchange fin; 61. fin structure; 611. notch; 612. flow deflector; 70. connecting pipe; 80. sealing cover; 90. flow guide channel; 100. shutter.

DETAILED DESCRIPTION OF THE EMBODIMENTS

It should be noted that, if there is no conflict, embodiments in the present disclosure and features in the embodiments can be combined with each other. Hereinafter, the present disclosure will be described in detail with reference to the drawings and in conjunction with the embodiments.

As shown in FIG. 1 to FIG. 9, embodiment 1 of the present disclosure provides a heat exchanger. The heat exchanger includes flat pipes 10, a first sealing cushion block 20 and a flow collecting portion, wherein a plurality of flat pipes 10 are provided, the plurality of flat pipes 10 are disposed at intervals, each of the plurality of flat pipe 10 is provided with an inlet portion 11 and an outlet portion 12, both the inlet portion 11 and the outlet portion 12 are located on a first end of a corresponding flat pipe 10, and the both the inlet portion 11 and the outlet portion 12 are disposed at intervals; and the first sealing cushion block 20 is disposed between two adjacent flat pipes 10 of the plurality of flat pipes 10, the first sealing cushion block 20 is located on a first end of the two adjacent flat pipes 10 of the plurality of flat pipes 10, so as to seal a gap between the two adjacent flat pipes 10 of the plurality of flat pipes by the first sealing cushion block 20. The flow collecting portion is provided with a first opening portion and a second opening portion, the first opening portion is disposed opposite to the inlet portion 11 of the each of the plurality of flat pipes 10, and the second opening portion is disposed opposite to the outlet portion 12 of the each of the plurality of flat pipes 10. The first sealing cushion block 20 includes a first sealing portion 21 and a second sealing portion 22, the first sealing portion 21 is disposed between the inlet portions 11 of the two adjacent flat pipes 10, the second sealing portion 22 is disposed between the outlet portions 12 of the two adjacent flat pipes 10 of the plurality of flat pipes 10, the inlet portion 11 of the each of the plurality of flat pipes 10 and at least part of the first sealing portion 21 are both plugged into the first opening portion, so as to form a first flow collecting channel in a surrounding manner, and the outlet portion 12 of the each of the plurality of flat pipes 10 and at least part of the second sealing portion 22 are both plugged into the second opening portion, so as to form a second flow collecting channel in a surrounding manner.

According to the technical solutions of some embodiments in the present embodiment, by disposing the inlet portion 11 and the outlet portion 12 of the flat pipe 10 on the same end of the flat pipe 10, only the first sealing cushion block 20 needs to be disposed on one end of the flat pipe 10. By plugging both at least part of the first sealing portion 21 and the inlet end of the flat pipe 10 into the first opening portion, the flow collecting channel on the inlet side can be formed in the encircling manner, and by plugging both at least part of the second sealing portion 22 and the inlet end of the flat pipe 10 into the second opening portion, the flow collecting channel on the outlet side can be formed in the encircling manner, therefore the flow collecting channel on the inlet side and the flow collecting channel on the outlet side are located on the same end of the flat pipe 10, which is convenient to improve the compactness of the overall structure.

At the same time, during welding, the flat pipe 10 is not constrained in a height direction. In some embodiments, when the heat exchanger is welded in a furnace, the flat pipe 10 can be freely declined under the pre-tightening action of a fixture. After a composite layer on the surface of the flat pipe 10 is melted, two pipe plates of the flat pipe 10 can always be kept pressed and bound, so as to ensure that all welding points on the pipe plates can be welded together, such that the connection strength between the flow collecting portion and the flat pipe 10 is improved, and the pressure resistance of a product is ensured.

In some embodiments, the flow collecting portion includes a first flow collecting shell 31, the first flow collecting shell 31 includes a first main shell and a first plug-in shell, the first plug-in shell is disposed on the first main shell, the first plug-in shell is located on an end portion of the first main shell, the first plug-in shell is provided with the first opening portion, and the inlet portion 11 of the each of the plurality of flat pipes 10 and at least part of the first sealing portion 21 are both plugged at the first plug-in shell. In some embodiments, the first main shell and the first plug-in shell become an integrally formed structure, so as to improve the structural strength. In some embodiments, the first main shell is an arc-shaped shell so as to form the flow collecting channel on the inlet side in the encircling manner, and the first flow collecting shell 31 is a C-shaped opening shell structure.

The flow collecting portion further includes a second flow collecting shell 32, the second flow collecting shell 32 includes a second main shell and a second plug-in shell, the second plug-in shell is disposed on the second main shell, the second plug-in shell is located on an end portion of the second main shell, the second plug-in shell is provided with the second opening portion, and the outlet portion 12 of the each of the plurality of flat pipes 10 and at least part of the second sealing portion 22 are both plugged at the second plug-in shell. In some embodiments, the first flow collecting shell 31 is connected with the second flow collecting shell 32, or, the first flow collecting shell 31 and the second flow collecting shell 32 are disposed separately. In some embodiments, the first flow collecting shell 31 and the second flow collecting shell 32 are disposed separately, so as to facilitate production and manufacture. In some embodiments, the second main shell and the second plug-in shell become an integrally formed structure, so as to improve the structural strength. In some embodiments, the second main shell is an arc-shaped shell so as to form the flow collecting channel on the outlet side in the encircling manner, and the second flow collecting shell 32 is a C-shaped opening shell structure.

In some embodiments, the first plug-in shell includes a first plug board and a second plug board, the first plug board and the second plug board are oppositely disposed on both ends of the first main shell, and the first plug board and the second plug board are disposed at intervals so as to form the first opening portion, so that the inlet portion 11 of the each of the plurality of flat pipes 10 and at least part of the first sealing portion 21 are both plugged between the first plug board and the second plug board. By using such settings, the connection stability among the first sealing portion 21, the inlet end of the flat pipe 10 and the first flow collecting shell 31 can be further improved, thereby preventing the first sealing portion 21, the inlet portion 11 of the flat pipe 10 and the first flow collecting shell 31 from falling off before welding. In some embodiments, the first plug board and the second plug board can also be disposed in parallel. Or, along an extension direction from the main shell to the plug-in shell, the distance between the first plug board and the second plug board gradually decreases, so as to better improve the stability of a plug-in connection and to better improve the connection stability among the first sealing portion 21, the inlet portion 11 of the flat pipe 10 and the first flow collecting shell 31.

Besides, the second plug-in shell includes a third plug board and a fourth plug board, the third plug board and the fourth plug board are oppositely disposed on both ends of the second main shell, and the third plug board and the fourth plug board are disposed at intervals so as to form the second opening portion, so that the outlet portion 12 of the each of the plurality of flat pipes 10 and at least part of the second sealing portion 22 are both plugged between the third plug board and the fourth plug board. By using such settings, the connection stability among the second sealing portion 22, the outlet portion 12 of the flat pipe 10 and the second flow collecting shell 32 can be further improved; thereby preventing the second sealing portion 22, the outlet portion 12 of the flat pipe 10 and the second flow collecting shell 32 from falling off before welding.

In some embodiments, the first sealing portion 21 includes a first main body block 211 and a first plug-in block 212, the first plug-in block 212 is disposed on the first main body block 211, the first main body block 211 is disposed on the first end of the two adjacent flat pipes 10, and the first plug-in block 212 is plugged into the first opening portion. By using such settings, the gap between the two adjacent flat pipes 10 can be sealed by the first main body block 211, and the first plug-in block 212 can be conveniently plugged into the first opening portion, so as to form the flow collecting channel on the inlet side in the encircling manner. In the present embodiment, the first main body block 211 and the first plug-in block 212 can be an integrally formed structure. In some embodiments, the first sealing portion 21 in the some embodiments is a T-shaped block, the T-shaped block can plugged into an opening side of the C-shaped flow collecting shell, an inner side wall of the end portion of the C-shaped flow collecting shell is clamped with an outer side wall of the T-shaped block, and the first sealing cushion block 20, the first flow collecting shell 31 and the flat pipe 10 are integrated after brazing. A plurality of first sealing cushion blocks 20 that are stacked together can be disposed between two adjacent flat pipes 10 according to actual situations. The structure of the second sealing portion 22 is the same as that of the first sealing portion 21.

Besides, the second sealing portion 22 includes a second main body block 221 and a second plug-in block 222, the second plug-in block 222 is disposed on the second main body block 221, the second main body block 221 is disposed on the first end of the two adjacent flat pipes 10, and the second plug-in block 222 is plugged into the first opening portion. The structure of the second sealing portion 22 can be similar to that of the first sealing portion 21.

In some embodiments, the first plug-in block 212 has a first side surface, a second side surface and a first arc-shaped concave surface, the first side surface, the first arc-shaped concave surface and the second side surface are connected in sequence, the first arc-shaped concave surface is located on one side of the first plug-in block 212 away from the first main body block 211, the first side surface is plugged at the first plug board, and the second side surface is plugged at the second plug board. By using such settings, it is possible to facilitate a better plug-in connection and improve the stability of the connection. At the same time, by arranging the first arc-shaped concave surface between the first side surface and the second side surface, a blocking effect of the first plug-in block 212 on the flow of fluid in the first flow collecting shell 31 can be reduced, such that a flow cross-sectional area in the first flow collecting shell 31 is increased, and the flow speed of the fluid is improved.

And the heat exchanger further includes a plurality of first positioning structures 23 and a plurality of second positioning structures 13 matching the plurality of first positioning structures 23, the heat exchanger includes a plurality of the first sealing cushion blocks 20, a first end of each of the plurality of flat pipes 10 is provided with one second positioning 13 of the plurality of second positioning structures 13, and the plurality of first positioning structures 23 are disposed opposite to the plurality of second positioning structures 23 in a one-to-one correspondence manner, so as to position the plurality of first sealing cushion blocks 20 by means of a cooperation of the plurality of first positioning structures 23 and the plurality of second positioning structures 13, and then the stability of positioning is improved. In some embodiments, both the first sealing portion 21 and the second sealing portion 22 are provided at least one first positioning structure 23 of the plurality of first positioning structures 23, so as to further improve the stability of setting.

In some embodiments, each of the plurality of first positioning structures 23 is a first positioning protrusion, each of the plurality of second positioning structures 13 is a first positioning groove, the first positioning protrusion is disposed opposite to the first positioning groove, and the first positioning protrusion is disposed in the first positioning groove, so as to position the first sealing cushion block 20.

In some embodiments, each of the plurality of first sealing cushion blocks 20 has a first fitting surface and a second fitting surface, which are disposed opposite to each other, the first end of the flat pipe 10 has a first surface and a second surface, which are disposed opposite to each other, the first fitting surface and the first surface of one flat pipe 10 of the two adjacent flat pipes 10 are disposed in a matching manner, and the second fitting surface and the second surface of another flat pipe 10 of the two adjacent flat pipes 10 are disposed in the matching manner, so that the first fitting surface is disposed to fit a corresponding first surface, and the second fitting surface is disposed to fit a corresponding second surface. In some embodiments, along a flow direction of fluid in the first flow collecting shell 31, the first sealing cushion block 20 has the first fitting surface and the second fitting surface, which are disposed opposite to each other. By using such a setting, the gap between the two adjacent flat pipes 10 can be better sealed by the first sealing cushion block 20, so as to prevent the fluid from leaking out from the gap between the first sealing cushion block 20 and the flat pipe 10.

In some embodiments, the first surface is a first arc-shaped convex surface, the second surface is a second arc-shaped convex surface, the first fitting surface is a first arc-shaped concave surface, and the second fitting surface is a second arc-shaped concave surface. The first arc-shaped concave surface is fitted to the first arc-shaped convex surface, and the second arc-shaped concave surface is fitted to the second arc-shaped convex surface, so that the first sealing cushion block 20 can better seal the gap between the two adjacent flat pipes 10, and the sealing effect is thus further improved.

In some embodiments, the flow collecting portion is further provided with a third opening portion and a fourth opening portion, which are disposed opposite to each other, and are disposed to form a preset angle with the flow direction of the fluid in each of the plurality of flat pipes 10 along an extension direction from the third opening portion to the fourth opening portion. The heat exchanger further includes a plurality of sealing covers 80, and both the third opening portion and the fourth opening portion are respectively provided with at least one sealing cover 80 of the plurality of sealing covers 80, so as to seal the third opening portion and the fourth opening portion by the plurality of sealing covers 80, and the sealing performance is thus improved.

In some embodiments, the heat exchanger further includes a plurality of second sealing cushion blocks 40, the plurality of sealing covers 80 are respectively provided at both ends of the plurality of flat pipes 10, at least one second sealing cushion block 40 of the plurality of the second sealing cushion blocks 40 is disposed between a flat pipe 10 located at an end of the plurality of flat pipes 10 and a corresponding sealing cover 80, and one end of each of the plurality of second sealing cushion blocks 40 close to the corresponding sealing cover 80 is provided with a third positioning structure, so as to position the corresponding sealing cover 80 by the third positioning structure. By using such settings, the stability of setting can be improved.

In some embodiments, each of the plurality of second sealing cushion blocks 40 includes a third sealing portion 41 and a fourth sealing portion 42, the third sealing portion 41 and the fourth sealing portion 42 are connected with each other, the third sealing portion 41 is disposed at the inlet portion 11 of the flat pipe located at an end of the plurality of flat pipes, and the fourth sealing portion 42 is disposed at the outlet portion 12 of the flat pipe located at an end of the plurality of flat pipes.

In some embodiments, the third positioning structure includes a first positioning step, the third sealing portion 41 includes a third main body block 411 and a third plug-in block 412, the third plug-in block 412 is disposed on the third main body block 411, and the third main body block 411 protrudes from the third plug-in block 412 to form the first positioning step in a surrounding manner, so as to position the sealing cover 80 by the first positioning step; and the third positioning structure includes a second positioning step, the fourth sealing portion 42 includes a fourth main body block 421 and a fourth plug-in block 422, the fourth plug-in block 422 is disposed on the fourth main body block 421, and the fourth main body block 421 protrudes from the fourth plug-in block 422 to form the second positioning step in a surrounding manner, so as to position the sealing cover 80 by the second positioning step. Or, the third positioning structure includes a first positioning step and a second positioning step, the third sealing portion 41 includes a third main body block 411 and a third plug-in block 412, the third plug-in block 412 is disposed on the third main body block 411, the third main body block 411 protrudes from the third plug-in block 412 to form the first positioning step in a surrounding manner, so as to position the sealing cover 80 by the first positioning step, the fourth sealing portion 42 includes a fourth main body block 421 and a fourth plug-in block 422, the fourth plug-in block 422 is disposed on the fourth main body block 421, and the fourth main body block 421 protrudes from the fourth plug-in block 422 to form the second positioning step in a surrounding manner, so as to position the sealing cover 80 by the second positioning step.

In some embodiments, a fourth positioning structure is further disposed on the flat pipe 10 located at an end of the plurality of flat pipes 10, a fifth positioning structure 43 matching the fourth positioning structure is further disposed on the second sealing cushion block 40, and the fourth positioning structure is disposed opposite to the fifth positioning structure 43, so as to position the second sealing cushion block 40 by the fourth positioning structure and the fifth positioning structure 43. By using such settings, the second sealing cushion block 40 can be conveniently positioned by means of the cooperation of the fourth positioning structure and the fifth positioning structure 43, thereby avoiding the movement of the second sealing block 40 relative to the flat pipe 10, and improving setting stability of the second sealing cushion block 40.

In some embodiments, the fourth positioning structure is a second positioning protrusion, the fifth positioning structure 43 is a second positioning groove, the second positioning protrusion is disposed opposite to the second positioning groove, and the second positioning protrusion is disposed in the second positioning groove, so as to position the second sealing portion 22. By using such settings, the stability of setting can be further improved.

Each of the plurality of flat pipes 10 is provided with a fluid channel, and the fluid channel is a U-shaped structure, so that the inlet portion 11 and the opening portion are both located on the same end of a corresponding flat pipe 10.

In some embodiments, the end portion of the flat pipe 10 is provided with an arc-shaped port, the arc-shaped port is plugged into the first opening portion, and the arc-shaped port communicates with the fluid channel in the flat pipe 10, so that the flow collecting channel communicates with the fluid channel in the flat pipe 10. By using such settings, the flow cross-sectional area in the flow collecting shell can be increased.

In some embodiments, the flow collecting portion, the flat pipe 10 and the first sealing cushion block 20 are welded to form the flow collecting channel in a surrounding manner, such that the flow collecting portion, the flat pipe 10 and the first sealing cushion block 20 form an integrated structure.

The heat exchanger further includes heat exchange fins 60, side plates 50 and a connecting pipe 70, the heat exchange fins 60 are disposed on the flat pipe 10, the side plates 50 are located on the end portions of the heat exchanger, and the connecting pipe 70 is used for communicating with the flow collecting channel.

Figure 10:
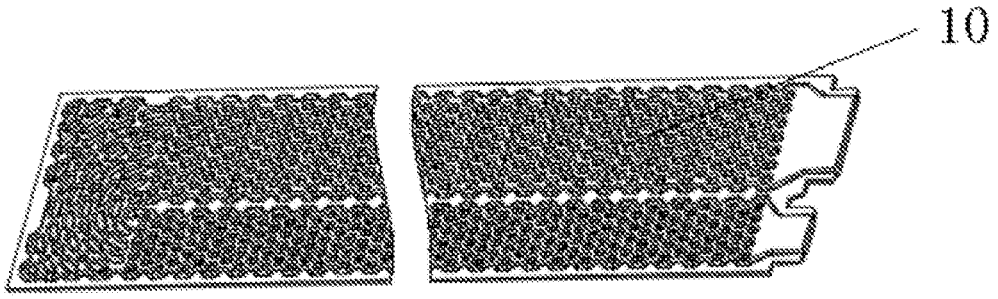
FIG. 10 illustrates a schematic structural diagram of a flat pipe of a heat exchanger provided according to Embodiment 2 of the present disclosure.

Embodiment 2 of the present disclosure provides a heat exchanger. The difference between the heat exchanger in Embodiment 2 and the heat exchanger in Embodiment 1 lies in the structure of the flat pipe 10. The structure of the flat pipe 10 of the heat exchanger in Embodiment 2 is shown in FIG. 10.

Figure 11:
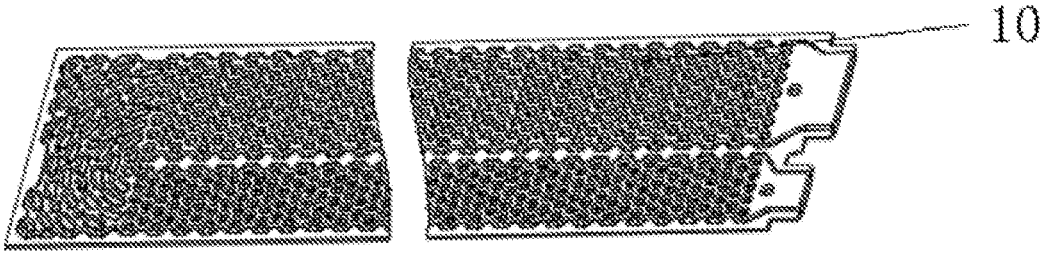
FIG. 11 illustrates a schematic structural diagram of a flat pipe of a heat exchanger provided according to some embodiments of the present disclosure.

Embodiment 3 of the present disclosure provides a heat exchanger. The difference between the heat exchanger in Embodiment 3 and the heat exchanger in Embodiment 1 lies in the structure of the flat pipe 10. The structure of the flat pipe 10 of the heat exchanger in Embodiment 3 is shown in FIG. 11.

Figure 12:
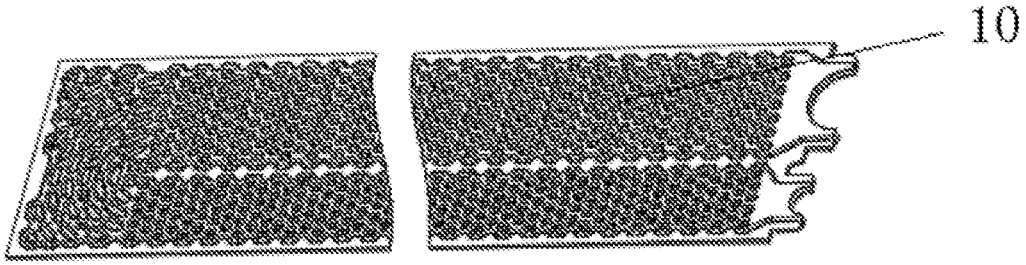
FIG. 12 illustrates a schematic structural diagram of a flat pipe of a heat exchanger provided according to some embodiments of the present disclosure.
Figure 13:
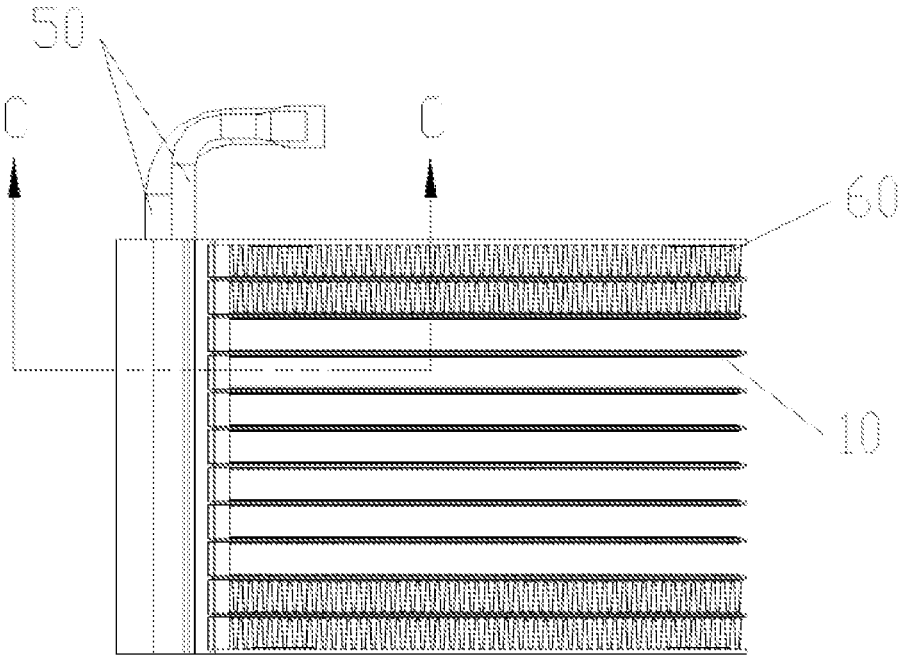
FIG. 13 illustrates a front view of a heat exchanger with a trumpet-shaped first plug-in block provided according to some embodiments of the present disclosure.
Figure 14:
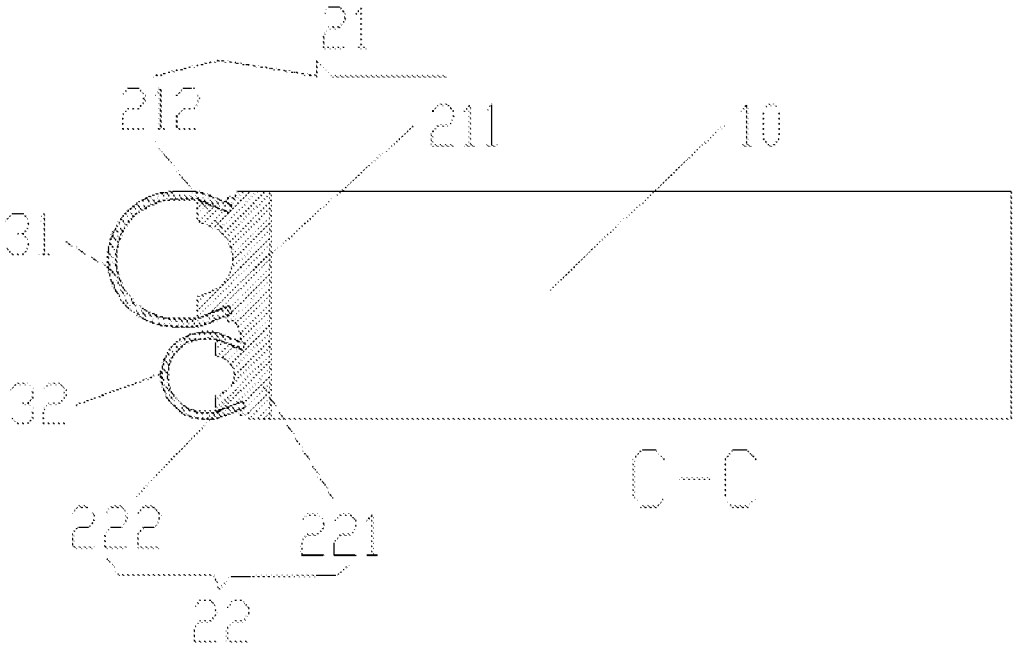
FIG. 14 illustrates a C-C direction view in FIG. 13.
Figure 15:
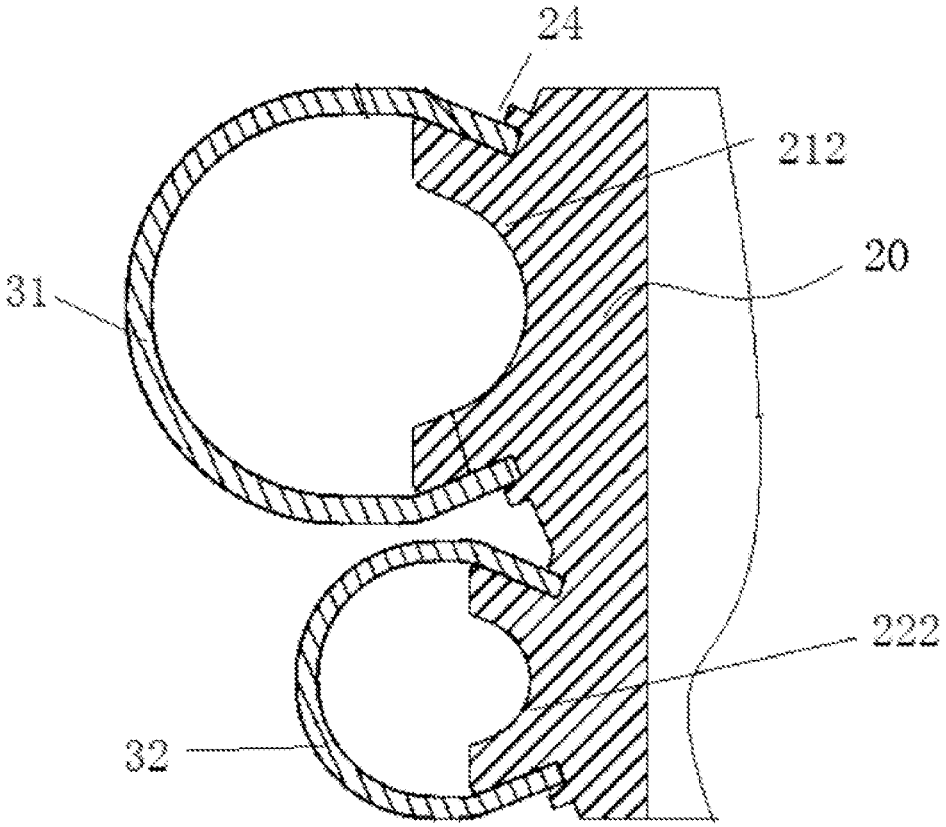
FIG. 15 illustrates a schematic diagram of a partial structure in FIG. 13.
Figure 16:
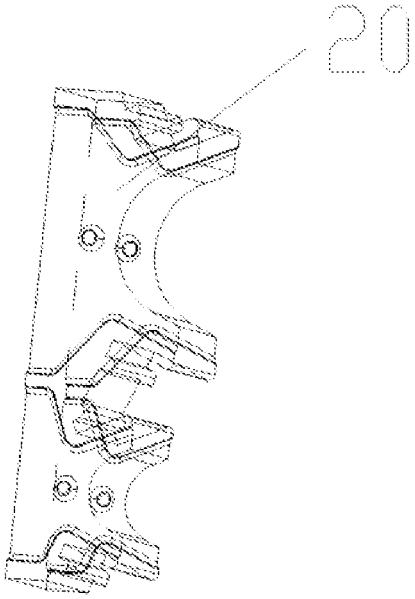
FIG. 16 illustrates a schematic structural diagram of a first sealing cushion block in FIG. 13.
Figure 17:
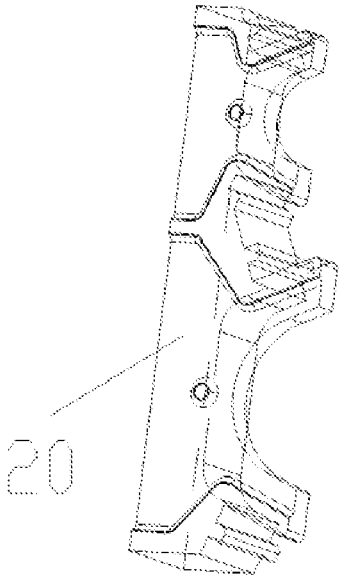
FIG. 17 illustrates another structural schematic diagram of the first sealing cushion block in FIG. 13.
Figure 18:
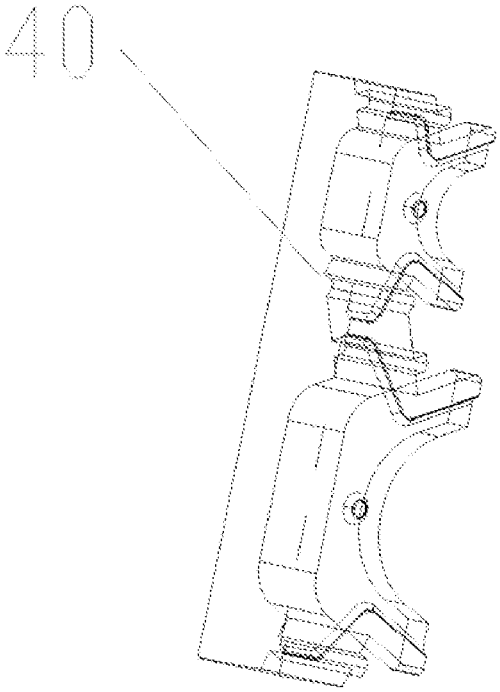
FIG. 18 illustrates a schematic structural diagram of a second sealing cushion block in FIG. 13.
Figure 19:
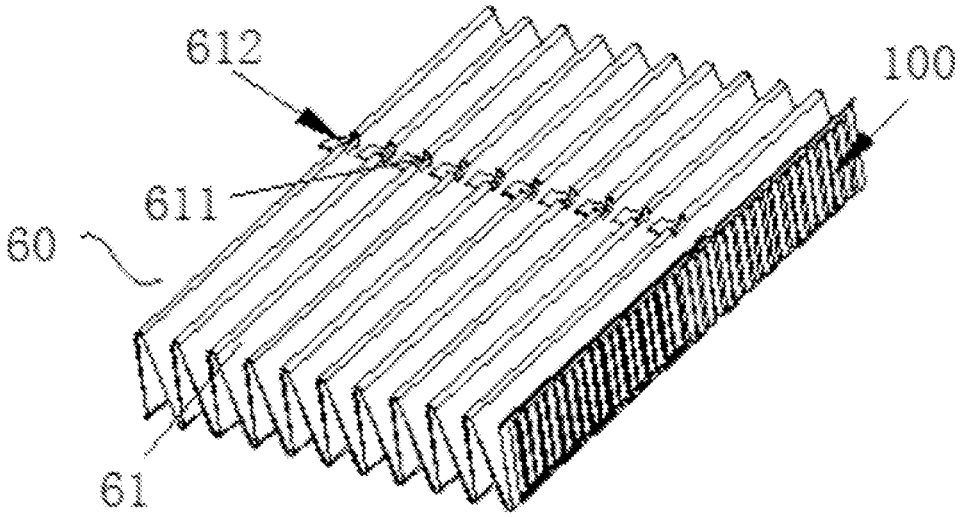
FIG. 19 schematically illustrates a structural diagram of some embodiments of a fin plate in the present disclosure.

Embodiment 4 of the present disclosure provides a heat exchanger. The difference between the heat exchanger in Embodiment 4 and the heat exchanger in Embodiment 1 lies in the structure of the flat pipe 10. The structure of the flat pipe 10 of the heat exchanger in Embodiment 4 is shown in FIG. 12.

As shown in FIG. 13 to FIG. 18, another embodiment of the present disclosure provides a heat exchanger. The heat exchanger includes flat pipes 10, a first sealing cushion block 20 and a flow collecting shell, wherein a plurality of flat pipes 10 are provided, and the plurality of flat pipes 10 are disposed at intervals. The first sealing cushion block 20 is located at an end portion of the flat pipe 10, so as to seal a gap between two adjacent flat pipes 10 of the plurality of flat pipes 10 by the first sealing cushion block 20. The first sealing cushion block 20 is provided with a main body portion and a plug-in portion, the plug-in portion is disposed on the main body portion, and the main body portion is disposed between the two adjacent flat pipes 10. The flow collecting shell is provided with an opening portion, the plug-in portion and the end portion of the flat pipe 10 are both plugged into the opening portion, so that the flow collecting shell, the flat pipe 10 and the first sealing cushion block 20 form a flow collecting channel in a surrounding manner. Along an extension direction from the main body portion to the plug-in portion, a plug-in width of the plug-in portion gradually increases. In some embodiments, the plug-in portion includes a first plug-in protrusion, an arc-shaped connecting block and a second plug-in protrusion, the first plug-in protrusion and the second plug-in protrusion are oppositely disposed on both ends of the arc-shaped connecting block, one end of the arc-shaped connecting block close to the flow collecting shell is provided with an arc-shaped end surface, both a first outer wall surface of the first plug-in protrusion and a second outer wall surface of the second plug-in protrusion are used for fitting with the flow collecting shell, and the plug-in width of the plug-in portion refers to the distance between the first outer wall surface and the second outer wall surface.

According to the heat exchanger provided by the present embodiment, by plugging at least part of the first sealing cushion blocks 20 and the end portions of the flat pipes 10 into the first opening portion, the flow collecting shell, a plurality of flat pipes 10 and a plurality of first sealing cushion blocks 20 can form the flow collecting channel in a surrounding manner. In this way, during a welding process, the flat pipe 10 is not constrained in a height direction. When the heat exchanger is welded in a furnace, the flat pipe 10 can be freely declined under the pre-tightening action of a fixture, after a composite layer on the surface of the flat pipe 10 is melted, two pipe plates of the flat pipe 10 can always be kept pressed and bound, so as to ensure that all welding points on the pipe plates can be welded together, such that the connection strength between the flow collecting shell 30 and the flat pipe 10 is improved, and the pressure resistance of a product is ensured.

At the same time, in some embodiments, by gradually increasing the plug-in width of the plug-in portion, it is convenient to improve the plug-in stability of the plug-in portion at the opening portion, and reduce the probability of the plug-in portion falling off the opening portion. It is convenient to further improve the welding quality, so as to better improve the connection strength between the flow collecting pipe and the flat pipe 10. In some embodiments, by using the plug-in portion, self-locking with the flow collecting shell can be facilitated to prevent a torrent shell from slipping off the plug-in portion in a transfer process of a core body. Meanwhile, it is possible to limit the situation that the size of the opening portion becomes large under the action of thermal stress, resulting in an excessive fit clearance, which in return leads to the failure of capillary action. Therefore, the situation of unstable welding is further avoided, and an effect of effectively improving and enhancing the welding quality can be realized.

In some embodiments, the flat pipe 10 is provided with an inlet portion 11 and an outlet portion 12, the inlet portion 11 and the outlet portion 12 are disposed at intervals, both the inlet portion 11 and the outlet portion 12 are located on the same end of the flat pipe 10, the opening portion includes a first opening portion and a second opening portion, the plug-in portion includes a first plug-in block 212 and a second plug-in block 222, the main body portion includes a first main body block 211 and a second main body block 221, and the first plug-in block 212 and the second plug-in block 222 are disposed at intervals. Both the first plug-in block 212 and the inlet portion 11 are plugged into the first opening portion, so that the flow collecting shell, the inlet portion 11 and the first sealing cushion block 20 form a flow collecting channel on an inlet side in an encircling manner. Both the second plug-in block 222 and the outlet portion 12 are plugged into the second opening portion, so that the flow collecting shell, the outlet portion 12 and the first sealing cushion block 20 form a flow collecting channel on an outlet side in the encircling manner. By using the structure of the flat pipe 10 provided in the present embodiment, the overall structural layout is more compact, and meanwhile, it is not necessary to dispose the first sealing cushion blocks 20 on the both ends of the flat pipe 10, therefore installation and operation of staff are facilitated, and the manufacturing costs can also be reduced. In some embodiments, the flow collecting shell includes a first flow collecting shell 31 and a second flow collecting shell 32, both the first flow collecting shell 31 and the second flow collecting shell 32 can be C-shaped opening shells, and the first sealing cushion block 20 is a T-shaped block.

The first main body block 211 and the first plug-in block 212 in the present embodiment are connected to form a first sealing portion 21 in the present embodiment, and the second main body block 221 and the second plug-in block 222 in the present embodiment are connected to form a second sealing portion 22 in the present embodiment.

The first plug-in block 212 is trumpet-shaped; or, the second plug-in block 222 is trumpet-shaped; or, the first plug-in block 212 is trumpet-shaped, and the second plug-in block 222 is trumpet-shaped. By using the above structural settings, the plug-in stability can be improved, and accordingly falling off is avoided.

In order to further improve the stability of setting, the heat exchanger in the present embodiment further includes a clamping structure, and the clamping structure is disposed on the first sealing cushion block 20, so that at least part of the flow collecting portion is clamped into the clamping structure.

In some embodiments, the clamping structure includes a clamping groove 24, and the clamping groove 24 is disposed on the first sealing cushion block 20, so that when the plug-in portion is plugged into the opening portion, at least part of the flow collecting shell is plugged into the clamping groove 24. Specifically, a plurality of clamping grooves 24 can be provided, and the plurality of clamping grooves 24 are disposed at intervals, so that at least part of the flow collecting shell is plugged into the plurality of clamping grooves 24. By using such settings, the stability of clamping can be further improved.

In some embodiments, the first flow collecting shell 31 includes a first main shell and a first plug-in shell, the first plug-in shell is disposed on the first main shell, the first plug-in shell includes a first plug board and a second plug board, the first plug board and the second plug board are oppositely disposed on both ends of the first main shell, and the first plug board and the second plug board are disposed at intervals. There are four clamping grooves 24, two clamping grooves 24 are respectively disposed on both sides of the first plug-in portion, and the remaining two clamping grooves 24 are respectively disposed on the both sides of the second plug-in portion, so that when the plug-in portion is plugged into the opening portion, the first plug board is plugged into one clamping groove, and the second plug board is plugged into the other clamping groove 24. By using such settings, a clamping shell can be better clamped on a clamping portion, so as to better improve the stability of clamping.

In some embodiments, along an extension direction from the first main shell to the first plug-in shell, a plug-in gap of the first plug-in shell gradually decreases; and along an extension direction from the second main shell to the second plug-in shell, the plug-in gap of the second plug-in shell gradually decreases. In this way, the situation in which the plug-in shell falls off the plug-in portion can be better avoided.

In some embodiments, the first plug-in block 212 has a first side surface, an arc-shaped surface and a second side surface; the first side surface, the first arc-shaped concave surface and the second side surface are connected in sequence, both the first side surface and the second side surface are used for fitting with the first flow collecting shell 31, and the arc-shaped surface is used for encircling with the flow collecting shell, so as to form a flow collecting channel. By such settings, it is possible to reduce a blocking effect of the first plug-in block 212 on the fluid in the flow collecting channel, so as to facilitate the smooth flow of the fluid in the flow collecting shell. The second plug-in block 222 is configured to have the same structure as the first plug-in block 212.

Besides, the inlet portion 11 is a first arc-shaped port, and the first arc-shaped port is plugged into the first opening portion, so that the first opening portion communicates with a fluid channel in the flat pipe 10 by means of the first arc-shaped port. Or, the outlet portion 12 is a second arc-shaped port, and the second arc-shaped port is plugged into the second opening portion, so that the second opening portion communicates with the fluid channel in the flat pipe 10 by means of the second arc-shaped port. Or, the inlet portion 11 is a first arc-shaped port, and the first arc-shaped port plugged into the first opening portion, so that the first opening portion communicates with the fluid channel in the flat pipe 10 by means of the first arc-shaped port; and the outlet portion 12 is a second arc-shaped port, and the second arc-shaped port is plugged into the second opening portion, so that the second opening portion communicates with the fluid channel in the flat pipe 10 by means of the second arc-shaped port. By using such settings, the blocking effect of the fluid in the flow collecting channel of the plug-in portion can be reduced, so as to facilitate the smooth flow of the fluid in the flow collecting shell.

In some embodiments, the inlet portion 11 is a first arc-shaped port, and the first arc-shaped port is plugged into the first opening portion, so that the first opening portion communicates with the fluid channel in the flat pipe 10 by means of the first arc-shaped port; and the outlet portion 12 is a second arc-shaped port, and the second arc-shaped port is plugged into the second opening portion, so that the second opening portion communicates with the fluid channel in the flat pipe 10 by means of the second arc-shaped port. By using such settings, the blocking effect of the first arc-shaped port on the fluid in the first flow collecting channel, and the blocking effect of the second arc-shaped port on the fluid in the second flow collecting shell 32 can be better avoided.

Besides, the heat exchanger further includes a second sealing cushion block 40, end covers, a connecting pipe 70 and heat exchange fins 60, and the end covers are disposed on two opposite ends of the flow collecting shell, so as to seal the flow collecting shell by means of the end covers. The second sealing cushion block 40 is disposed between the end cover and the flat pipe 10, so as to seal the gap between the end cover and the flat pipe 10 by means of the second sealing cushion block 40. The second sealing cushion block 40 includes a second main body portion, a third plug-in portion and a fourth plug-in portion, both the third plug-in portion and the fourth plug-in portion are disposed on the second main body portion, the third plug-in portion and the fourth plug-in portion are disposed at intervals, the third plug-in portion protrudes from the second main body portion so as to form a first positioning step, the fourth plug-in portion protrudes from the second main body portion so as to form a second positioning step, the first flow collecting shell 31 is positioned by means of the first positioning step, and the second flow collecting shell 32 is positioned by means of the second positioning step. Along the extension direction from the second main body portion to the third plug-in portion, the plug-in width of the third plug-in portion gradually increases, so as to improve the plug-in stability. Along the extension direction from the second main body portion to the fourth plug-in portion, the plug-in width of the fourth plug-in portion gradually increases, so as to improve the plug-in stability.

The flat pipe of a double-row bent micro-channel heat exchanger in the art known to inventors is formed by welding two forming plates. A refrigerant circulation area of each forming plate is divided by a rib into a refrigerant inlet part and a refrigerant outlet part. Due to the existence of the rib on the forming plate, a groove is formed on a contact surface of the flat pipe and the fin. When the double-row bent micro-channel heat exchanger is used as an evaporator, the flat pipe is also placed vertically. Unlike conventional micro-channels, condensed water can either flow downward along a shutter of the fin or along a vertical groove on the flat pipe. However, due to a limited thickness of the flat pipe and a small size of the groove, the condensed water cannot flow downward along the groove due to the capillary action, which will also lead to poor drainage, thus affecting the heat exchange performance.

In order to solve the above problems, as shown in FIG. 19 to FIG. 23, an embodiment of the present disclosure provides a heat exchange device. The heat exchange device includes the plurality of flat pipes 10 and a heat exchange fin 60, wherein each of the plurality of flat pipes 10 includes a first forming plate and a second forming plate, a surface of the flat pipe 10 is provided with a groove 14 extending along a length direction of the flat pipe 10, and the groove 14 is formed by the first forming plate and the second forming plate by means of depressing toward the inner side of the flat pipe 10; and the heat exchange fin 60 is installed between adjacent flat pipes 10, the heat exchange fin 60 is provided with a plurality of notches 611 at a location corresponding to the groove, the heat exchange fin 60 comprises a plurality of flow deflectors 612, the plurality of notches 611 and the plurality of flow deflector are disposed in an one-to-to corresponding manner, and the plurality of notches 611, a plurality of flow deflectors 612 and the plurality of grooves 14 form a flow guide channel 90 together. The heat exchange device of the present disclosure includes the flat pipes 10 and the heat exchange fins 60, the fins are provided with the notches 611 at the locations corresponding to the grooves 14, the flow guide channel 90 formed by a plurality of notches, the grooves and the flow deflectors can guide condensed water from top to bottom, thereby increasing the path for the condensed water to flow down, and the retention of the condensed water is thus avoided. At the same time, the flow deflectors at the plurality of notches can form flow channels with relatively smooth side walls in a vertical direction, thereby being more conducive to the flow of the condensed water. The shape of the notch can be a rectangle, a trapezoid or other shapes.

Figure 20:
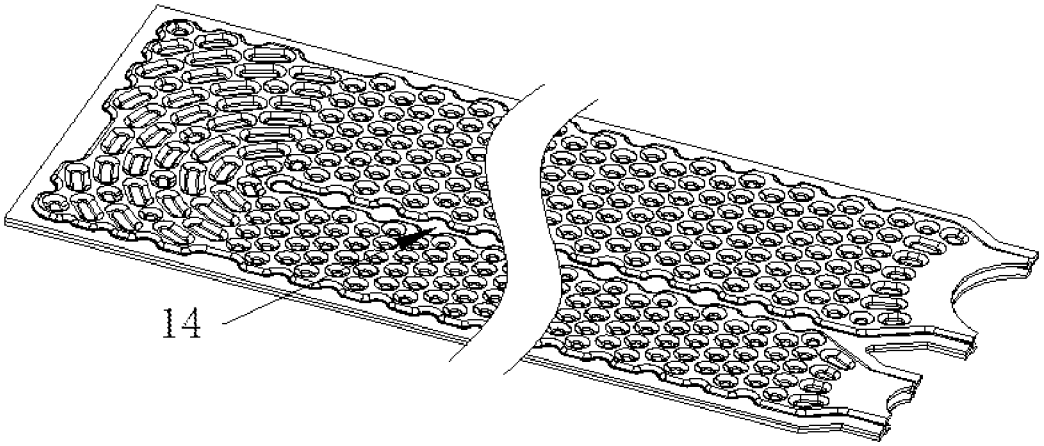
FIG. 20 schematically illustrates a structural diagram of some embodiments of a flat pipe with a groove in the present disclosure.
Figure 21:
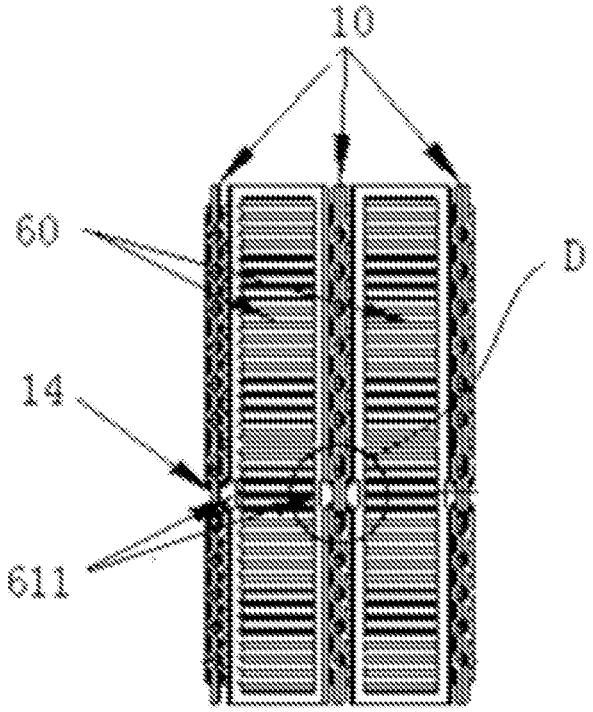
FIG. 21 schematically illustrates a structural diagram of some embodiments of the present disclosure in which a heat exchange plate and a fin plate are installed together.
Figure 22:
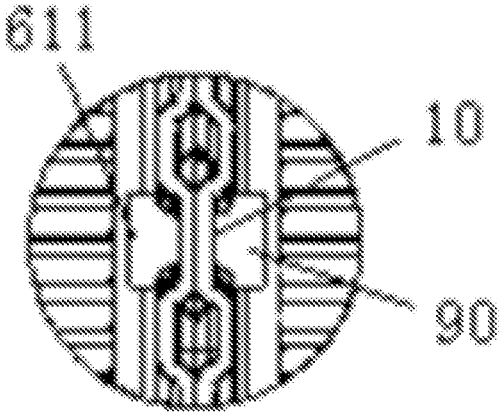
FIG. 22 schematically illustrates an enlarged view of an area D in FIG. 21.
Figure 23:
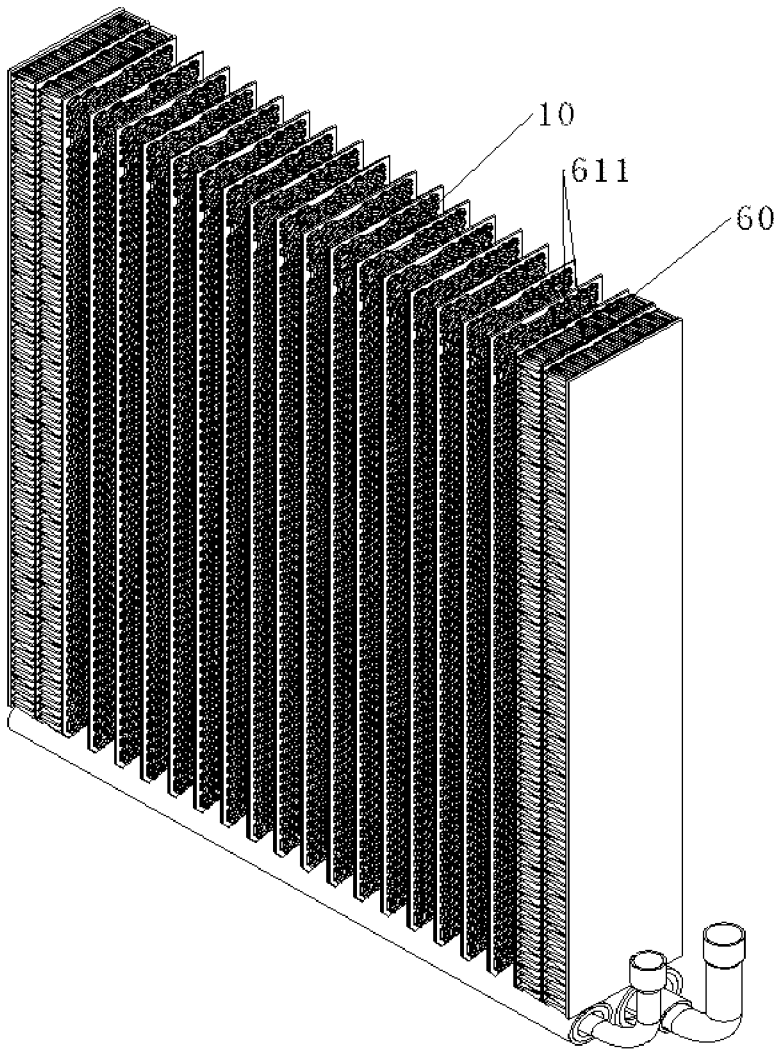
FIG. 23 schematically illustrates a structural diagram of some embodiments of a heat exchange device of the present disclosure.

As shown in FIG. 20 to FIG. 22, in the present embodiment, the flat pipe 10 is provided with grooves 14 from top to bottom, flow guide slots are disposed opposite to the grooves 14, and the flow guide slots form the flow guide channel 90 together with the grooves 14. By means of the cooperation of the flow guide slots and the grooves, the flow guide channel is formed, and the flow guide channel has a greater flow area, thereby solving the problem of poor drainage more effectively.

In some embodiments, the heat exchange fin 60 is corrugated sheet, and the notches 611 disposed at wave crests and wave troughs of the heat exchange fins 60, so as to reasonably utilize fin structures 61 to form the notches.

The flow deflector 612 is a part of the heat exchange fin 60, which is formed by the heat exchange fin 60 by depressing along the notch 611, and the flow deflector 612 does not penetrate through the heat exchange fin 60. Each of the plurality of flow deflectors 612 is located on one side of the heat exchange fin 60.

For the convenience of processing, a flanging processing method is utilized in the present embodiment. Specifically, the flow deflector 612 is a part of the heat exchange fin 60, which is formed by folding the heat exchange fin 60 along one side of the notch 611. During processing, two slits can be processed on a flaky structure of the fin, then a region between the two slits, that is, the flow deflector, is bent downward to form the notch, and the flow deflector is located below the notch.

In some embodiments, the plurality of flow deflectors 612 are all folded in the same direction. In the present embodiment, the lower end of the flow deflector 612 abuts against the inner wall of the notch 611 adjacent to the flow deflector 612. Since the lower end of the flow deflector 612 abuts against the inner wall of the notch 611 adjacent to the flow deflector 612, a side wall in the vertical direction, which is formed by the plurality of flow deflectors, is more conducive to the flow of the condensed water.

In some embodiments, the flow deflector 612 is parallel to a length direction of the flat pipe 10. In another embodiment, the length of the flow deflector 612 in the present embodiment is less than the wave pitch of the heat exchange fin 60, wherein the wave pitch is the wave pitch of the corrugated sheet, that is, the distance between two adjacent corrugated vertices.

In some embodiments, a shutter 100 is formed on the heat exchange fin 60, wherein the depth of the notch 611 is less than the distance from the top of the heat exchange fin to the shutter 100.

In some embodiments, the flat pipe 10 is provided with an inlet portion and an outlet portion, the inlet portion and the outlet portion are located on the same end of the flat pipe 10, and both the inlet portion and the outlet portion have an arc-shaped structure, so as to facilitate the introduction and extraction of a heat exchange agent.

As shown in FIG. 21, in order to conveniently supply a heat exchange agent into a heat exchange plate, the heat exchange device in the present embodiment further includes a flow collecting pipe, the flow collecting pipe is disposed at the end portion of the flat pipe 10, and the interior of the flat pipe 10 communicates with the flow collecting pipe.

In some embodiments, for the convenience of processing, a flanging processing method is utilized in the present embodiment. In some embodiments, in the present embodiment, the flow deflector 612 is a part of a fin structure, and the flow deflector 612 is bent downward to form the notch 611. During processing, two slits can be processed on the fin structure, then a region between the two slits, that is, the flow deflector, is bent downward to form the notch, and the flow deflector is located below the notch. In the present embodiment, the lower end of the flow deflector 612 abuts against the inner wall of the notch 611 adjacent to the flow deflector 612. On one hand, the side wall in the vertical direction, which is formed by the plurality of flow deflectors, is more smooth. On the other hand, by setting the flow deflector to be longer, the area of the notch can be larger, and the flow area can be larger.

In some embodiments, the flow collecting pipe is disposed at the bottom of the flat pipe 10, and the end portion of the flow collecting pipe is further provided with a connecting pipe that is connected to an external pipeline.

For the convenience of processing, in the present embodiment, the heat exchange fins 60 are formed by bending a metal plate for many times, and a plurality of fin structures 61 are bending protrusions of the bent metal plate. In other embodiments, the plurality of fins can also be a plurality of metal plates that are disposed separately, and the fin structures are the metal plates. In order to ensure the spatial stability of the flow guide channel, in the present embodiment, the side walls of part of the plurality of notches 611 abut against the side walls of the guide grooves 14.

From the above descriptions, it can be seen that the above-mentioned embodiments of the present disclosure achieve the following technical effects: the connection strength between the flow collecting shell and the flat pipe is improved, the pressure resistance of the heat exchanger is improved, the flow area in the flow collecting shell is increased, the flow resistance in the flow collecting channel is reduced, and the influence on the performance of a refrigeration system is reduced. Since the inlet portion and the outlet portion are located on the same end, installation and welding are facilitated, the number of sealing cushion blocks used is reduced, and the cost is reduced. The structure is more compact, and temperature fields on front and rear rows of a fin side are more uniform. Compared with two side-by-side heat exchangers, under the same windward area, the heat exchange capacity and the heat exchange efficiency are improved, and the space of the unit is saved. There is a U-shaped channel inside a heat exchange pipe, a refrigerant flow through a U-shaped loop in the flat pipe, the widths of the two flow channels of the "U"-shaped loop can be adjusted, and the widths of a flow channel of the inlet portion and the flow channel of the outlet portion can be equal or unequal (preferably unequal). When used as an evaporator, a liquid multi-flow channel of the inlet portion is narrow, and a gas multi-flow channel of the outlet portion is wide; and when used as a condenser, the gas multi-flow channel of the inlet portion is wide, and the liquid multi-flow channel of the outlet portion is narrow, and by adjusting the widths of the flow channels of the inlet portion and the outlet portion, pressure drop on a liquid side and a gas side in a refrigerant loop is optimized, and an effect of reducing the total pressure drop is realized. The connection stability between the flow collecting shell and the plug-in portion is enhanced, the flow collecting shell is prevented from falling off the plug-in portion, the failure of the capillary action resulting from an excessive fit clearance between the flow collecting shell and the plug-in portion during the welding process is prevented, and the welding quality is improved and enhanced. The heat exchange fins of the present disclosure are provided with the notches at the locations corresponding to the grooves, the flow guide channel formed by the plurality of notches, the grooves and the flow deflectors can guide the condensed water from top to bottom, thereby increasing the path for the condensed water to flow down, and the retention of the condensed water is thus avoided. At the same time, the flow deflectors at the plurality of notches can form flow channels with relatively smooth side walls in the vertical direction, thereby being more conducive to the flow of the condensed water.

The above descriptions are only preferred embodiments of the present disclosure, and are not intended to limit the present disclosure. For those skilled in the art, the present disclosure can have various modifications and changes. Any modifications, equivalent replacements, improvements and the like, made within the spirit and principle of the present disclosure, shall be included within the protection scope of the present disclosure.

What is claimed is:

1. A heat exchanger, comprising:

a plurality of flat pipes, wherein the plurality of flat pipes are disposed at intervals, each of the plurality of flat pipes is provided with an inlet portion and an outlet portion, both the inlet portion and the outlet portion are located on a first end of a corresponding flat pipe, and the both the inlet portion and the outlet portion are disposed at intervals;

a first sealing cushion block, disposed between two adjacent flat pipes of the plurality of flat pipes, wherein the first sealing cushion block is located on a first end of the two adjacent flat pipes of the plurality of flat pipes, so as to seal a gap between the two adjacent flat pipes of the plurality of flat pipes by the first sealing cushion block; and a flow collecting portion, provided with a first opening portion and a second opening portion, wherein the first opening portion is disposed opposite to the inlet portion of the each of the plurality of flat pipes, and the second opening portion is disposed opposite to the outlet portion of the each of the plurality of flat pipes, wherein the first sealing cushion block comprises a first sealing portion and a second sealing portion, the first sealing portion is disposed between inlet portions (11) of the two adjacent flat pipes of the plurality of flat pipes, the second sealing portion is disposed between outlet portions of the two adjacent flat pipes of the plurality of flat pipes, the inlet portion of the each of the plurality of flat pipes and at least part of the first sealing portion are both plugged into the first opening portion, so as to form a first flow collecting channel in a surrounding manner, and the outlet portion of the each of the plurality of flat pipes and at least part of the second sealing portion are both plugged into the second opening portion, so as to form a second flow collecting channel in a surrounding manner;

wherein each of the plurality of flat pipes comprises a first forming plate and a second forming plate, the surface of the each of the plurality of flat pipes is provided with a groove extending along a length direction of the each of the plurality of flat pipes, and the groove is formed by the first forming plate and the second forming plate by means of depressing toward inner sides of the each of the plurality of flat pipes; and the heat exchanger further comprises:

a heat exchange fin, the heat exchange fin is installed between the two adjacent flat pipes of the plurality of flat pipes, the heat exchange fin is provided with a plurality of notches at a location corresponding to the groove the heat exchange fin comprises a plurality of flow deflectors, the plurality of notches and the plurality of flow deflector are disposed in an one-to-to corresponding manner, and the plurality of notches, the plurality of flow deflectors and the groove form a flow guide channel together.

2. The heat exchanger as claimed in claim 1, wherein the flow collecting portion comprises a first flow collecting shell, the first flow collecting shell comprises a first main shell and a first plug-in shell, the first plug-in shell is disposed on the first main shell, the first plug-in shell is located on an end portion of the first main shell, the first plug-in shell is provided with the first opening portion, and the inlet, portion of the each of the plurality of flat pipes and at least part of the first sealing portion are both plugged at the first plug-in shell.

3. The heat exchanger as claimed in claim 2, wherein the flow collecting portion comprises a second flow collecting shell, the second flow collecting shell comprises a second main shell and a second plug-in shell, the second plug-in shell is disposed on the second main shell, the second plug-in shell is located on an end portion of the second main shell, the second plug-in shell is provided with the second opening portion, and the outlet portion of the each of the plurality of flat pipes and at least part of the second sealing portion are both plugged at the second plug-in shell.

4. The heat exchanger as claimed in claim 2, wherein the first plug-in shell comprises a first plug board and a second plug board, the first plug board and the second plug board are oppositely disposed on both ends of the first main shell, and the first plug board and the second plug board are disposed at intervals so as to form the first opening portion, so that the inlet portion of the each of the plurality of flat pipes and at least part of the first sealing portion are both plugged between the first plug board and the second plug board.

5. The heat exchanger as claimed in claim 4, wherein the first sealing portion comprises a first main body block and a first plug-in block, the first plug-in block is disposed on the first main body block, the first main body block is disposed on the first end of the two adjacent flat pipes, and the first plug-in block is plugged into the first opening portion.

6. The heat exchanger as claimed in claim 5, wherein the first plug-in block has a first side surface, a second side surface and a first arc-shaped concave surface, the first side surface, the first arc-shaped concave surface and the second side surface are connected in sequence, the first arc-shaped concave surface is located on one side of the first plug-in block away from the first main body block, the first side surface is plugged at the first plug board, and the second side surface is plugged at the second plug board.

7. The heat exchanger as claimed in claim 1, wherein the heat exchanger further comprises a plurality of first positioning structures and a plurality of second positioning structures matching the plurality of first positioning structures, the heat exchanger comprises a plurality of the first sealing cushion blocks, a first end of each of the plurality of flat pipes is provided with one second positioning structure of the plurality of second positioning structures, and the plurality of first positioning structures are disposed opposite to the plurality of second positioning structures in a one-to-one correspondence manner, so as to position the plurality of first sealing cushion blocks by means of a cooperation of the plurality of first positioning structures and the plurality of second positioning structures, so as to position the plurality of first sealing cushion blocks by means of a cooperation of the plurality of first positioning structures and the plurality of second positioning structures.

8. The heat exchanger as claimed in claim 1, wherein the heat exchanger comprises a plurality of the first sealing cushion blocks, each of the plurality of first sealing cushion blocks has a first fitting surface and a second fitting surface, which are disposed opposite to each other, the first end of the each of the plurality of flat pipes has a first surface and a second surface, which are disposed opposite to each other, the first fitting surface and the first surface of one flat pipe of the two adjacent flat pipes are disposed in a matching manner, and the second fitting surface and the second surface of the another flat pipe of the two adjacent flat pipes are disposed in the matching manner, so that the first fitting surface is disposed to fit a corresponding first surface, and the second fitting surface is disposed to fit a corresponding second surface.

9. The heat exchanger as claimed in claim 1, wherein the flow collecting portion is further provided with a third opening portion and a fourth opening portion, which are disposed opposite to each other, and are disposed to form a preset angle with a flow direction of fluid in the each of the plurality of flat pipes along an extension direction from the third opening portion to the fourth opening portion; and the heat exchanger further comprises a plurality of sealing covers, and both the third opening portion and the fourth opening portion are respectively provided with at least one sealing cover of the plurality of sealing covers, so as to seal the third opening portion and the fourth opening portion by the plurality of sealing covers.

10. The heat exchanger as claimed in claim 9, wherein the heat exchanger further comprises a plurality of second sealing cushion blocks, the plurality of sealing covers are respectively provided at both ends of the plurality of flat pipes, at least one second sealing cushion block of the plurality of second sealing cushion blocks is disposed between a flat pipe located at an end of the plurality of flat pipes and a corresponding sealing cover, and one end of each of the plurality of second sealing cushion blocks close to the corresponding sealing cover is provided with a third positioning structure, so as to position the corresponding sealing cover by the third positioning structure.

11. The heat exchanger as claimed in claim 10, wherein each of the plurality of second sealing cushion blocks comprises a third sealing portion and a fourth sealing portion, the third sealing portion and the fourth sealing portion are connected with each other, the third sealing portion is disposed at the inlet portion of the flat pipe located at an end of the plurality of flat pipes, and the fourth sealing portion is disposed at the outlet portion of the flat pipe located at the end of the plurality of flat pipes;

the third positioning structure comprises a first positioning step, the third sealing portion comprises a third main body block and a third plug-in block, the third plug-in block is disposed on the third main body block, and the third main body block protrudes from the third plug-in block to form the first positioning step in a surrounding manner, so as to position the sealing cover by the first positioning step; and the third positioning structure comprises a second positioning step, the fourth sealing portion comprises a fourth main body block and a fourth plug-in block, the fourth plug-in block is disposed on the fourth main body block, and the fourth main body block protrudes from the fourth plug-in block to form the second positioning step in a surrounding manner, so as to position the sealing cover by the second positioning step.

12. The heat exchanger as claimed in claim 10, wherein a fourth positioning structure is further disposed on the flat pipe located at an end of the plurality of flat pipes, a fifth positioning structure matching the fourth positioning structure is further disposed on the second sealing cushion block, and the fourth positioning structure is disposed opposite to the fifth positioning structure, so as to position the second sealing cushion block by the fourth positioning structure and the fifth positioning structure.

13. The heat exchanger as claimed in claim 3, wherein, the first sealing portion comprises a first main body block and a first plug-in block, the first plug-in block is disposed on the first main body block, the first plug-in block and the inlet portion of the each of the plurality of flat pipes are both plugged into the first opening portion, so as to form the first flow collecting channel in a surrounding manner, and along an extension direction from the first main body block to the first plug-in block, a plug-in width of the first plug-in block gradually increases; and the second sealing portion comprises a second main body block and a second plug-in block, the second plug-in block is disposed on the second main body block, the second plug-in block and the outlet portion of the each of the plurality of flat pipes are both plugged into the second opening portion, so as to form the second flow collecting channel in a surrounding manner, and along an extension direction from the second main body block to the second plug-in block, a plug-in width of the second plug-in block gradually increases.

14. The heat exchanger as claimed in claim 1, wherein the heat exchanger further comprises:

a clamping structure, the clamping structure is disposed on the first sealing cushion block, and at least part of the flow collecting portion is clamped into the clamping structure.

15. The heat exchanger as claimed in claim 1, wherein, each of inlet portions of the plurality of flat pipes is a first arc-shaped port, and the first arc-shaped port is plugged into the first opening portion, so that the first flow collecting channel communicates with the fluid channel in the each of the plurality of flat pipes; and each of the outlet portions of the plurality of flat pipes is a second arc-shaped port, and the second arc-shaped port is plugged into the second opening portion, so that the second flow collecting channel communicates with the fluid channel in the each of the plurality of flat pipes.

16. The heat exchanger as claimed in claim 1, wherein the heat exchange fin is a corrugated sheet, and the plurality of notches are disposed at wave crests and wave troughs of the heat exchange fin respectively; or, wherein the heat exchanger comprises a shutter (100) which is formed on the heat exchange fin (60), and a depth of the notch (611) is less than a distance from a top of the heat exchange fin to the shutter(100).

17. The heat exchanger as claimed in claim 1, wherein each of the plurality of flow deflectors is a part of the heat exchange fin, each of the plurality of flow deflectors is formed by the heat exchange fin by depressing along a corresponding notch, and each of the plurality of flow deflectors is located on one side of the heat exchange fin.

18. The heat exchanger as claimed in claim 1, wherein each of the plurality of flow deflectors is a part of the heat exchange fin, each of the plurality of flow deflectors is formed by folding the heat exchange fin along one side of a corresponding notch.

19. The heat exchanger as claimed in claim 18, wherein the plurality of flow deflectors are all folded in a same direction;

or wherein each of the plurality of the flow deflectors is parallel to a length direction of each of the plurality of flat pipes;

or wherein a length of the flow deflector is less than a wave pitch of the heat exchange fin.

* * * * *